US008425208B2

(12) United States Patent
McCourt

(10) Patent No.: US 8,425,208 B2
(45) Date of Patent: Apr. 23, 2013

(54) AIR OPERATED DIAPHRAGM PUMP WITH ELECTRIC GENERATOR

(75) Inventor: Mark D. McCourt, Rittman, OH (US)

(73) Assignee: Warren Rupp, Inc., Mansfield, OH (US)

( * ) Notice: Subject to any disclaimer, the term of this patent is extended or adjusted under 35 U.S.C. 154(b) by 314 days.

(21) Appl. No.: 12/776,814

(22) Filed: May 10, 2010

(65) Prior Publication Data

US 2010/0284834 A1 Nov. 11, 2010

Related U.S. Application Data

(60) Provisional application No. 61/176,754, filed on May 8, 2009.

(51) Int. Cl.
*F04B 43/06* (2006.01)

(52) U.S. Cl.
USPC ..... 417/395

(58) Field of Classification Search ..... 417/395, 417/411, 269, 413.1; 290/54, 55; 310/311, 310/323.04, 324
See application file for complete search history.

(56) References Cited

U.S. PATENT DOCUMENTS

| | | | | |
|---|---|---|---|---|
| 3,741,689 | A | | 6/1973 | Rupp |
| 3,860,034 | A | | 1/1975 | Rupp |
| 4,381,180 | A | | 4/1983 | Sell |
| 4,475,665 | A | | 10/1984 | Norton |
| 4,478,560 | A | | 10/1984 | Rupp |
| 4,511,806 | A | | 4/1985 | May |
| 4,549,467 | A | | 10/1985 | Wilden et al. |
| 4,678,922 | A | * | 7/1987 | Leininger ..... 290/54 |
| 4,856,969 | A | | 8/1989 | Forsythe et al. |
| 4,966,528 | A | | 10/1990 | Henkel et al. |
| 5,174,731 | A | | 12/1992 | Korver |
| 5,252,041 | A | | 10/1993 | Schumack |
| 5,257,914 | A | | 11/1993 | Reynolds |
| 5,326,234 | A | | 7/1994 | Versaw et al. |
| 5,332,372 | A | | 7/1994 | Reynolds |
| 5,334,003 | A | | 8/1994 | Gardner et al. |
| 5,553,454 | A | | 9/1996 | Mortner |
| 5,567,477 | A | | 10/1996 | Snyder, Jr. |
| 5,620,746 | A | | 4/1997 | Snyder, Jr. |

(Continued)

FOREIGN PATENT DOCUMENTS

| | | | |
|---|---|---|---|
| EP | 1 118 754 | A2 | 7/2001 |
| EP | 1 712 795 | A1 | 10/2006 |
| WO | 2007/018304 | A2 | 2/2007 |
| WO | 2006/055626 | A2 | 8/2010 |

OTHER PUBLICATIONS

International Search Report, Sep. 1, 2010, 4 pages.
Written Opinion, Sep. 1, 2010, 7 pages.

(Continued)

*Primary Examiner* — Devon Kramer
*Assistant Examiner* — Yonas s Cherkos
(74) *Attorney, Agent, or Firm* — Brouse McDowell; Heather M. Barnes

(57) ABSTRACT

An air operated double diaphragm pump comprises an integrated electric generator and an air efficiency device. The integrated electric generator increases the portability of the air operated double diaphragm pump. The air efficiency device varies the amount of compressed fluid entering the pump between a high volume and a low volume dependent upon the velocity and position of the pump's diaphragm assemblies to optimize the pump's efficient use of the compressed air.

20 Claims, 7 Drawing Sheets

U.S. PATENT DOCUMENTS

| | | | | |
|---|---|---|---|---|
| 5,816,778 | A | 10/1998 | Elsey, Jr. et al. | |
| 5,839,883 | A | 11/1998 | Schmidt et al. | |
| 5,969,429 | A | 10/1999 | Rudolph et al. | |
| 5,996,627 | A | 12/1999 | Reynolds | |
| 6,036,445 | A | 3/2000 | Reynolds | |
| 6,099,264 | A | 8/2000 | Du | |
| RE36,917 | E | 10/2000 | Leininger | |
| 6,126,403 | A | 10/2000 | Yamada | |
| 6,129,525 | A | 10/2000 | Reynolds | |
| 6,132,176 | A | 10/2000 | Higgins | |
| 6,152,705 | A * | 11/2000 | Kennedy et al. | 417/395 |
| 6,158,982 | A * | 12/2000 | Kennedy et al. | 417/397 |
| 6,168,387 | B1 | 1/2001 | Able et al. | |
| 6,236,185 | B1 * | 5/2001 | Hines et al. | 320/101 |
| 6,241,487 | B1 | 6/2001 | Reynolds | |
| 6,273,686 | B1 | 8/2001 | Kroell et al. | |
| 6,280,149 | B1 | 8/2001 | Able et al. | |
| 6,431,425 | B1 | 8/2002 | Moorman et al. | |
| 6,511,201 | B1 | 1/2003 | Elrod | |
| 6,554,578 | B1 | 4/2003 | Siegel | |
| RE38,239 | E | 8/2003 | Duncan | |
| 6,619,932 | B2 * | 9/2003 | Murata | 417/395 |
| 6,874,997 | B2 | 4/2005 | Watanabe et al. | |
| 6,885,114 | B2 | 4/2005 | Baarman et al. | |
| 6,906,466 | B2 | 6/2005 | Feng | |
| 7,021,909 | B1 | 4/2006 | Steck | |
| 7,095,142 | B2 | 8/2006 | Leininger | |
| 7,112,892 | B2 | 9/2006 | Mahowald | |
| 7,218,009 | B2 | 5/2007 | Hendrickson et al. | |
| 7,360,999 | B2 | 4/2008 | Nelson et al. | |
| 7,517,199 | B2 | 4/2009 | Reed et al. | |
| 7,658,598 | B2 | 2/2010 | Reed et al. | |
| 2001/0048882 | A1 * | 12/2001 | Layman | 417/395 |
| 2004/0047748 | A1 * | 3/2004 | Roberts et al. | 417/395 |
| 2004/0047749 | A1 * | 3/2004 | Roberts et al. | 417/395 |
| 2004/0197211 | A1 * | 10/2004 | Murata | 417/395 |
| 2005/0188980 | A1 | 9/2005 | Monks et al. | |
| 2006/0104829 | A1 | 5/2006 | Reed et al. | |
| 2006/0147324 | A1 * | 7/2006 | Tanner et al. | 417/411 |
| 2007/0092386 | A1 | 4/2007 | Reed et al. | |
| 2007/0126416 | A1 | 6/2007 | Zhu et al. | |
| 2007/0248474 | A1 | 10/2007 | Dietzsch et al. | |
| 2009/0230924 | A1 * | 9/2009 | Wright | 320/148 |

OTHER PUBLICATIONS

International Preliminary Report on Patentability, Apr. 18, 2011, 8 pages.

* cited by examiner

AIR OPERATED DIAPHRAGM PUMP WITH ELECTRIC GENERATOR

This application claims priority to a provisional application having Ser. No. 61/176,754 filed on May 8, 2009.

I. BACKGROUND

A. Field of Invention

This invention pertains to the art of methods and apparatuses regarding air operated diaphragm pumps and more specifically to methods and apparatuses regarding integrated power sources for supplying electrical power to air operated diaphragm pumps as well as other apparatuses.

B. Description of the Related Art

Fluid-operated pumps, such as diaphragm pumps, are widely used particularly for pumping liquids, solutions, viscous materials, slurries, suspensions or flowable solids. Double diaphragm pumps are well known for their utility in pumping viscous or solids-laden liquids, as well as for pumping plain water or other liquids, and high or low viscosity solutions based on such liquids. Accordingly, such double diaphragm pumps have found extensive use in pumping out sumps, shafts, and pits, and generally in handling a great variety of slurries, sludges, and waste-laden liquids. Fluid driven diaphragm pumps offer certain further advantages in convenience, effectiveness, portability, and safety. Double diaphragm pumps are rugged and compact and, to gain maximum flexibility, are often served by a single intake line and deliver liquid through a short manifold to a single discharge line. One such double diaphragm pump that may be utilized in conjunction with the present invention is described in pending patent application Ser. No. 12/693,044 filed Jan. 25, 2010 and owned by IDEX AODD, Inc. and is incorporated herein by reference.

Commonly, diaphragm pumps include various components requiring electrical power. For example, an electric shifting mechanism may be used to control the reciprocal flow of pressurized fluid within a diaphragm pump. Also, diaphragm pumps may include a control system that allows the operation of the pump to be monitored and/or controlled. Although known diaphragm pumps work well for their intended purpose, several disadvantages exist. Often, the location or environment in which the pump is utilized makes it impracticable to connect the pump to a power outlet or stationary power source via external electrical wiring. Not having access to an external source of power may render the pump or components thereof inoperable. What is needed then is an integrated power supply for supplying electrical power to a diaphragm pump.

II. SUMMARY

One object of the present invention is to provide a pump comprising a first diaphragm assembly, wherein the first diaphragm assembly is disposed in a first chamber and includes a first diaphragm forming a first pumping chamber and a first diaphragm chamber within the first chamber; a second diaphragm assembly, wherein the second diaphragm assembly is disposed in a second chamber and includes a second diaphragm forming a second pumping chamber and a second diaphragm chamber within the second chamber, wherein a connecting rod is operatively connected to the first and the second diaphragms and allows the first and the second diaphragm assemblies to reciprocate together between a first diaphragm position and a second diaphragm position; a center section, wherein the center section at least partially causes a compressed fluid to be alternately supplied to or exhausted from the first and the second diaphragm chambers, and; an integrated power supply, wherein the integrated power supply utilizes compressed air supplied to the pump to supply power to at least a first component of the pump.

Another object of the present invention is to provide a pump wherein the integrated power supply generates an alternating current.

Still yet, another object of the present invention is to provide a pump wherein the integrated power supply generates a direct current.

Further another object of the present invention is to provide a pump wherein the integrated power supply comprises an impeller, a gear reduction assembly, and an alternator having a rotor and a stator, wherein at least a portion of the compressed air entering into the pump passes over the impeller and causes the impeller to rotate at a first velocity and generate a first torque, wherein the impeller is operatively connected to the gear reduction assembly, wherein the gear reduction assembly causes the rotor to rotate at a second velocity and generate a second torque.

Yet, another object of the present invention is to provide a pump wherein the integrated power supply further comprises a regulator, wherein the regulator regulates flow of compressed air across the impeller.

Another object of the present invention is to provide a pump wherein the integrated power supply further comprises a bridge rectifier.

Further yet, another object of the present invention is to provide a pump wherein the alternator comprises a plurality of magnets coupled to the stator, and a coil winding coupled to the rotor.

Another object of the present invention is to provide a pump wherein the integrated power supply further comprises a piezo-power assembly.

Still, another object of the present invention is to provide a pump wherein the piezo-power assembly, further comprises piezoelectric material, wherein vibration of the pump causes the piezoelectric material to produce an alternating current.

Still yet, another object of the present invention is to provide a pump wherein the alternating current results from the piezoelectric material producing a charge traveling in one direction when the piezoelectric material is subjected to stress and a charge traveling in the opposite direction when the piezoelectric material is subjected to strain.

Yet, another object of the present invention is to provide a pump wherein the integrated power supply further comprises a bridge rectifier, wherein the alternating current generated by the power supply is transformed to direct current by the bridge rectifier.

Further, another object of the present invention is to provide a method for supplying power to a pump, the method comprising the steps of:

providing a first diaphragm assembly, wherein the first diaphragm assembly is disposed in a first chamber and includes a first diaphragm forming a first pumping chamber and a first diaphragm chamber within the first chamber; a second diaphragm assembly, wherein the second diaphragm assembly is disposed in a second chamber and includes a second diaphragm forming a second pumping chamber and a second diaphragm chamber within the second chamber, wherein a connecting rod is operatively connected to the first and the second diaphragms and allows the first and the second diaphragm assemblies to reciprocate together between a first diaphragm position and a second diaphragm position; a center section, wherein the center section at least partially causes a compressed fluid to be alternately supplied to or exhausted from the first and the second diaphragm chambers, and; an integrated power supply;

generating electrical power, wherein the integrated power supply generates electrical power utilizing compressed air supplied to the pump.

Another object of the present invention is to provide a method for supplying power to a pump further comprising the step of:

generating alternating current to supply power to a pump component.

Further, another object of the present invention is to provide a method for supplying power to a pump further comprising the step of:

generating direct current to supply power to a pump component.

Yet, another object of the present invention is to provide a method for supplying power to a pump wherein the integrated power supply comprises:

an impeller;

a gear reduction assembly, the impeller operatively connected to the gear reduction assembly; and, an alternator, the method further comprising the steps of:

passing air entering into the pump over the impeller;

rotating the impeller at a first velocity;

generating a first torque, rotating a rotor at a second velocity via the gear reduction assembly; and generating a second torque.

Further, another object of the present invention is to provide a method for supplying power to a pump wherein the integrated power supply further comprises a regulator, the method further comprising the step of:

regulating flow of compressed air across the impeller.

Still yet, another object of the present invention is to provide a method for supplying power to a pump wherein the integrated power supply further comprises:

a bridge rectifier.

Another object of the present invention is to provide a method for supplying power to a pump wherein said integrated power supply further comprises a piezo-power assembly having piezoelectric material, the method further comprising the steps of:

producing alternating current or direct current utilizing vibration of the pump.

Further, another object of the present invention is to provide a method for supplying power to a pump further comprising the steps of:

subjecting the piezoelectric material to stress;

producing a charge traveling in one direction;

subjecting the piezoelectric material to strain; and producing a charge traveling in an opposite direction Further yet, another object of the present invention is to provide a method for supplying power to a pump wherein the integrated power supply further comprises a bridge rectifier, the method further comprising the step of:

transforming alternating current to direct current.

One advantage of this invention is that the operation of the pump or other apparatuses to be powered is not limited by the location and accessibility of an external source of power.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DETAILED DESCRIPTION

Figure 1:
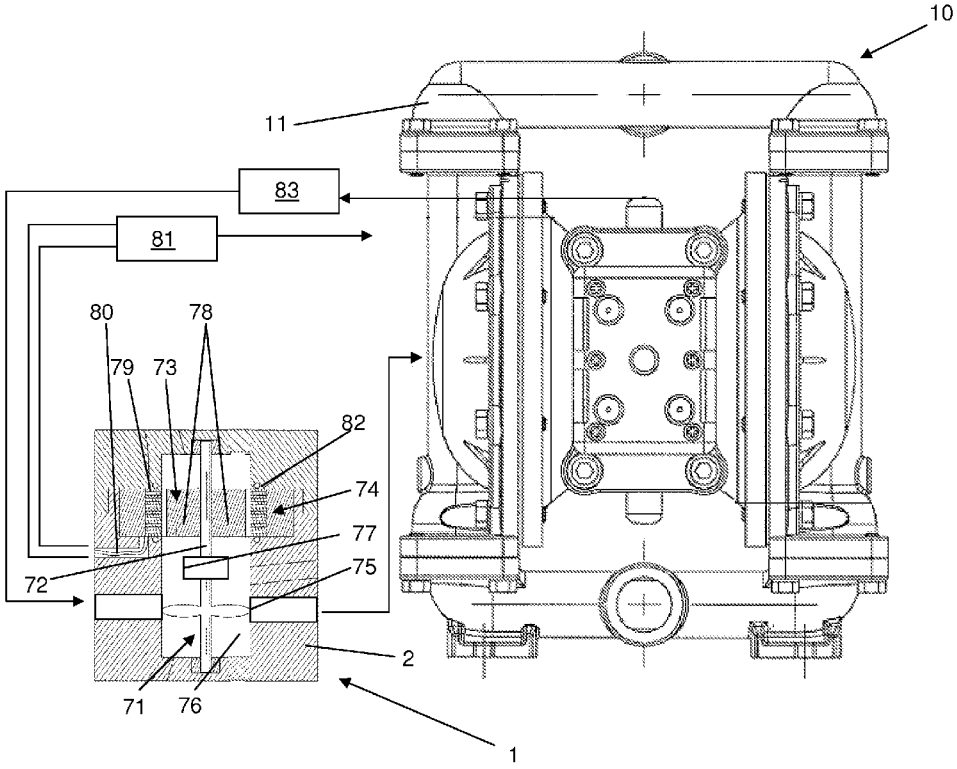
FIG. 1 shows an illustrative view of an air operated double diaphragm pump comprising a power supply according to one embodiment of the invention.

Referring now to the drawings wherein the showings are for purposes of illustrating embodiments of the invention only and not for purposes of limiting the same, FIGS. 1-5 illustrate the present invention. FIG. 1 shows an air operated double diaphragm pump 10 comprising a power supply 1 according to one embodiment of the invention. The power supply 1 may comprise an integrated power supply and may increase the utility and portability of the pump 10 by eliminating the requirement to connect the pump 10 to an external power source via external electrical wiring. The power supply 1 may comprise a generator or an alternator. The power supply 1 may generate direct and/or alternating current. Although the invention is described in terms of an air operated double diaphragm pump, the invention may be utilized with any type pump chosen with sound judgment by a person of ordinary skill in the art. The terms "compressed air," "compressed fluid," "air," and "fluid" may be used interchangeably and refer to a pressurized fluid suitable for operating a fluid powered diaphragm pump.

Figure 2:
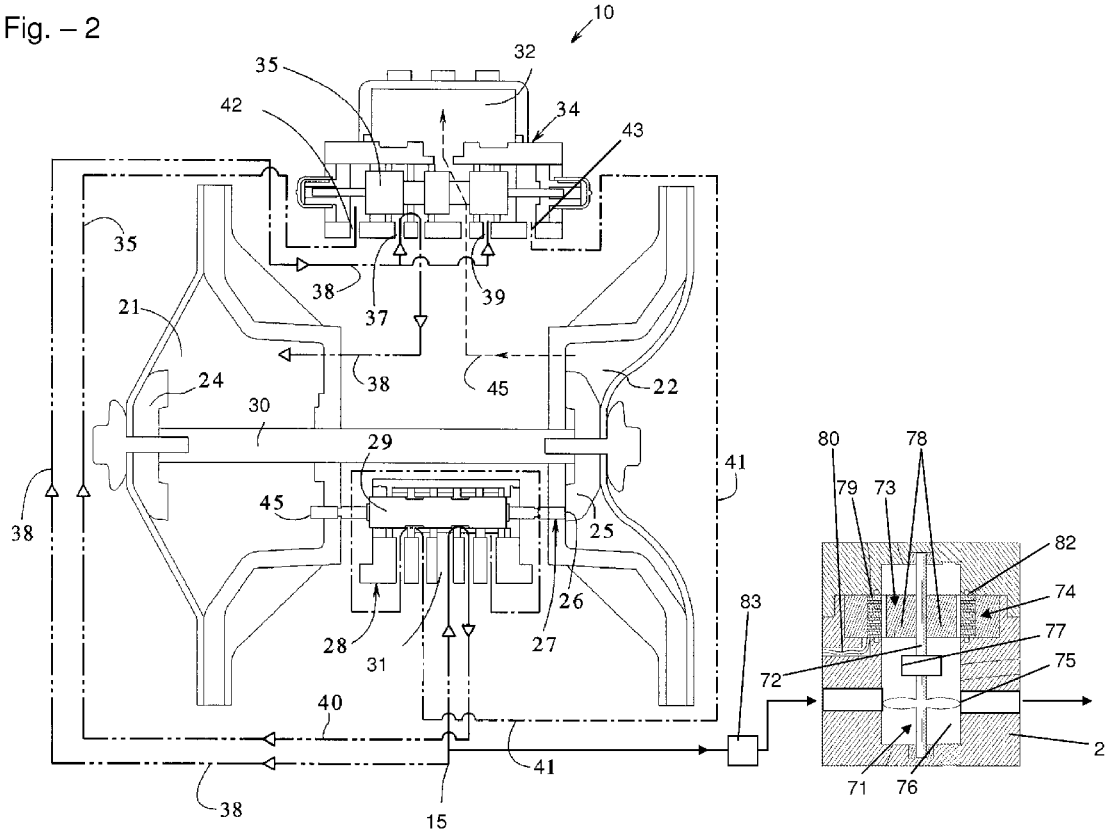
FIG. 2 shows a schematic illustration of an air operated double diaphragm pump, particularly illustrating the pump at the end of a pumping stroke in the left direction.
Figure 3:
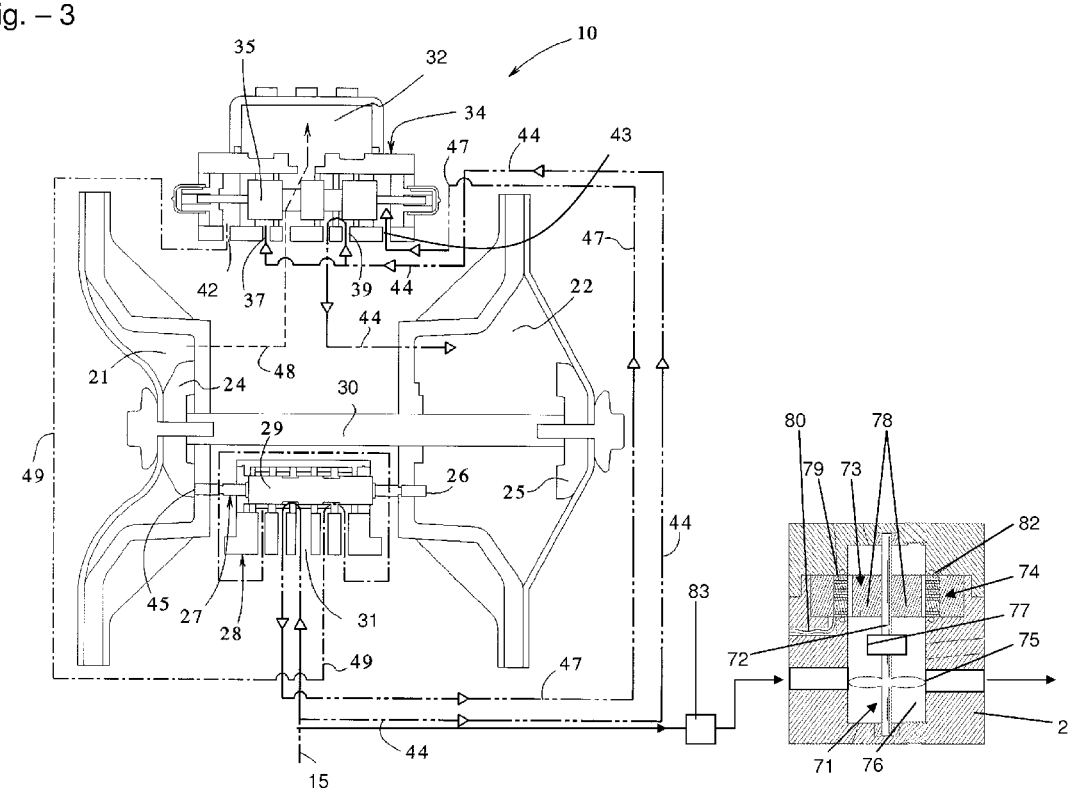
FIG. 3 shows a schematic illustration of an air operated double diaphragm pump, particularly illustrating the pump at the end of a pumping stroke in the right direction.

With reference now to FIGS. 1, 2, and 3, the pump 10 may now be generally described. The pump 10 may comprise a first diaphragm chamber 21 and a second diaphragm chamber 22. A connecting rod 30 may operatively connect a first diaphragm plate 24 to a second diaphragm plate 25. As the connecting rod 30 moves all the way to the left, as shown in FIG. 2, the second diaphragm plate 25 may engage the end of an actuator pin 27 thereby causing a pilot valve spool 29 to be shifted to the left. Compressed air entering the pump 10 through a pump inlet 15 may be directed into a pilot valve assembly 28 through a pilot inlet port 31. With the pilot valve spool 29 moved to the left position as shown in FIG. 2, the pilot valve assembly 28 may communicate compressed air to a first signal port 42 of the main fluid valve assembly 34, as illustrated by the line shown at 40. The communication of compressed air to the first signal port 42 may cause a main fluid valve spool 35 to be shifted from a leftmost position, shown in FIG. 2, to a rightmost position, shown in FIG. 3. In the leftmost position, shown in FIG. 2, compressed air entering the pump 10 through the pump inlet 15 may be communicated through a first inlet port 37 of the main fluid valve 34 and may be transmitted to the first diaphragm chamber 21, as illustrated by the line 38. Compressed air may also be communicated to a second inlet port 39 of the main fluid valve 34 but may be blocked by the main fluid valve spool 35 as shown in FIG. 2. As compressed air is directed into the first diaphragm chamber 21, compressed air may be vented or exhausted from the second diaphragm chamber 22 through an exhaust port 32 of the main fluid valve assembly 34, as illustrated by the line 45.

With continued reference now to FIGS. 1, 2, and 3, as indicated above, compressed air may be transmitted from the pilot valve 28 to the first signal port 42 of the main fluid valve 34. The transmission of compressed air to the first signal port 42 may cause the main fluid valve spool 35 to shift to the right and assume the rightmost position, shown in FIG. 3, thereby blocking entry of compressed fluid through the first inlet port 37 and permitting compressed fluid to enter the valve 34 through the second inlet port 39. The movement of the main fluid valve spool 35 to the right may be initiated upon the second diaphragm chamber 22 becoming substantially full of compressed air thereby causing the first diaphragm plate 24 to be moved to the right and caused to engage the end of the actuator pin 27. The engagement of the end of the actuator pin 27 by the first diaphragm plate 24 may cause the pilot valve spool 29 to be moved to the right. The movement of the pilot valve spool 29 to the right may cause compressed air entering the pilot valve assembly 28 to be transmitted to a second signal port 43 of the main air valve 34, as illustrated by the line 47. The communication of compressed air to the second signal port 43 may cause the main fluid valve spool 35 to be shifted to the left and assume the position shown in FIG. 2. However, with the main fluid valve spool 35 in the position as shown in FIG. 3, the first inlet port 37 may be blocked and compressed air may flow through the second inlet port 39 and into the second diaphragm chamber 22, as illustrated by the line 44. Compressed air from the first diaphragm chamber 21 may be vented or exhausted through the exhaust port 32, as illustrated by the line 48.

With reference now to FIG. 1, in one embodiment, the power supply 1 may utilize compressed air to supply electrical power to the pump 10. The power supply 1 may be used to supply electrical power to the pump 10, or components thereof, during operation of the pump 10 or, may supply electrical power to the pump 10 substantially continuously in conjunction with compressed air being supplied to the power supply 1. The power supply 1 may utilize compressed air entering the pump 10 through the pump inlet 15 or compressed air exhausted from the first and/or second diaphragm chambers 21, 22. In one embodiment, the power supply 1 may be used to recharge a battery, not shown, supplied to the pump 10, wherein the battery, not shown, is utilized to supply electrical power to the pump 10. The power supply 1 may be selectively coupled to the pump 10. The power supply 1 may comprise any type of structure or device for converting compressed air into electrical power chosen with sound judgment by a person of ordinary skill in the art. In one embodiment, the power supply 1 may comprise a power supply housing 2 that enables the power supply 1 to be selectively coupled to the pump housing 11. In another embodiment, the power supply 1 may comprise an integrated component that is substantially contained within the pump housing 11.

Figure 4:
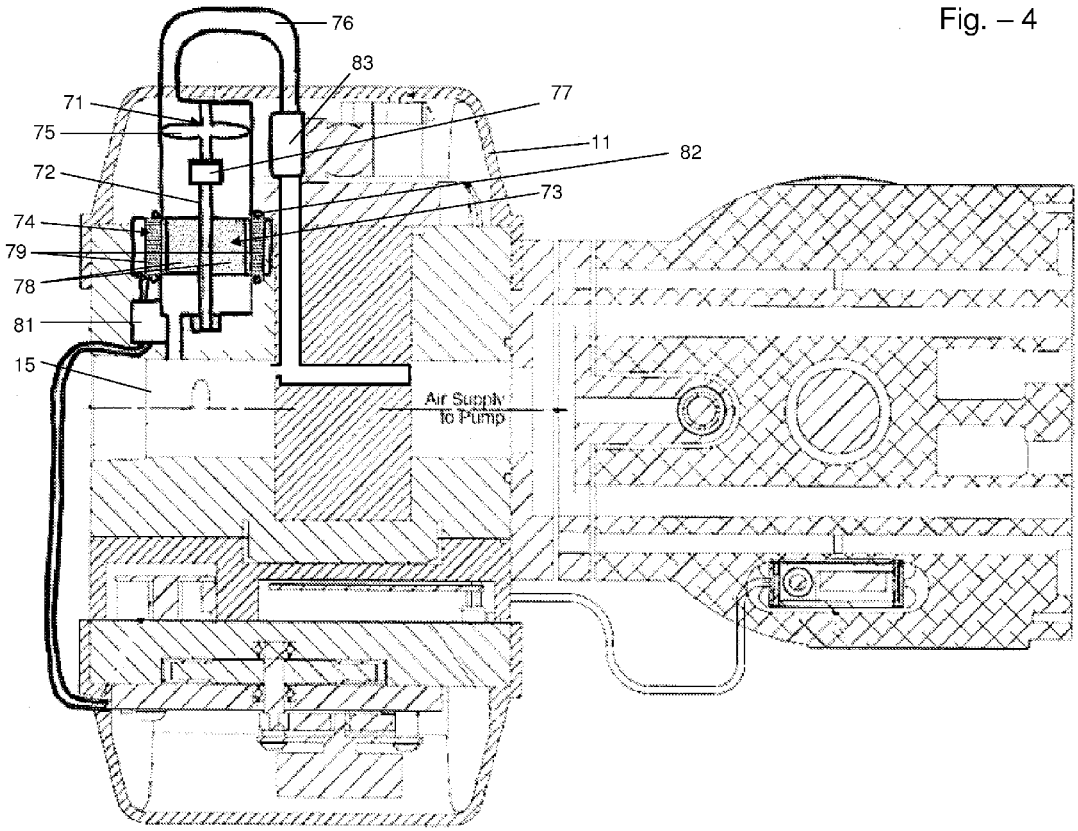
FIG. 4 shows a partial cut-away view of an air operated double diaphragm pump having a power supply according to one embodiment of the invention.
Figure 5:
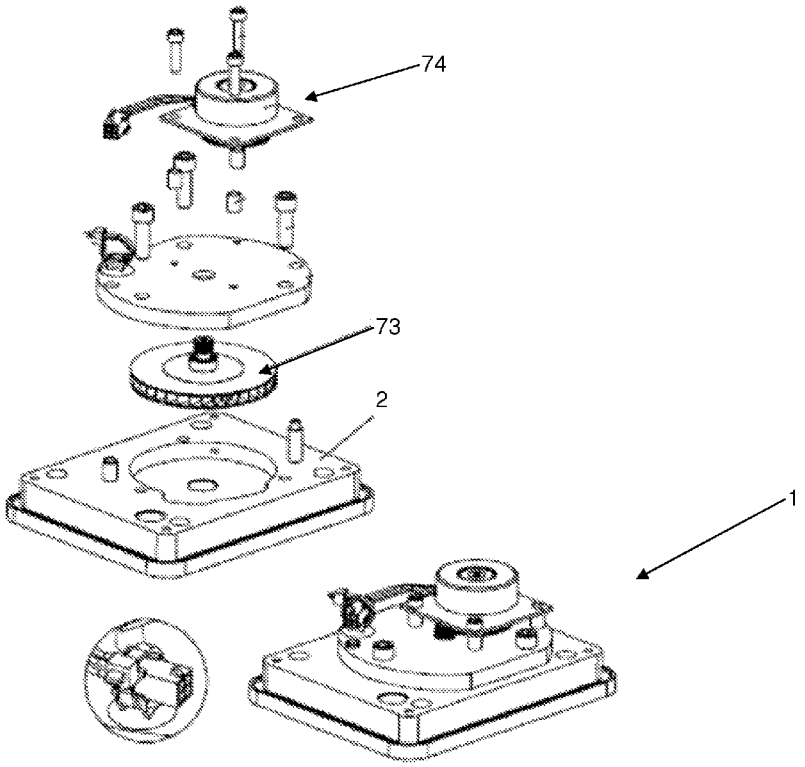
FIG. 5 shows an assembly view of the power supply according to one embodiment of the invention.
Figure 6A:
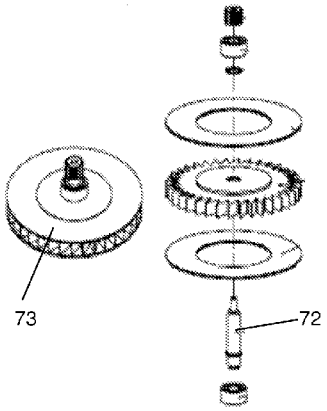
FIG. 6A shows an assembly view of the rotor assembly shown in FIG. 5.
Figure 6B:
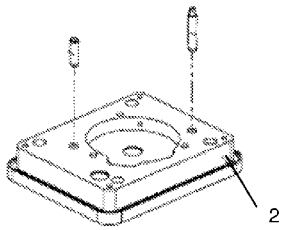
FIG. 6B shows an assembly view of the case assembly shown in FIG. 5.
Figure 6C:
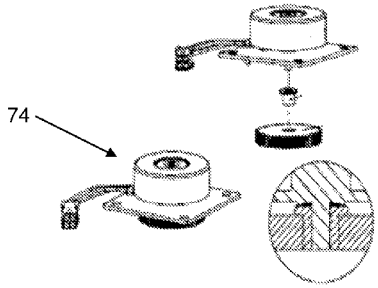
FIG. 6C shows an assembly view of the generator assembly shown in FIG. 5.

With reference now to FIGS. 1, 4, and 5, in one embodiment, the power supply 1 may generate an alternating current. The power supply 1 may comprise an impeller 71, a rotor shaft 72, a rotor 73, and a stator 74. The impeller 71 may comprise a plurality of blades 75 that at least partially extend into at least a portion of a fluid passage 76. At least a portion of the compressed air supplied to the pump 10 may be directed to flow through the fluid passage 76. The compressed air flowing through the fluid passage 76 may at least partially cause the rotation of the impeller 71 by exerting a force on at least a portion of the blades 75. In one embodiment, the compressed air flowing through the fluid passage 76 may cause the impeller 71 to rotate at about 2000 rotations per minute (rpm). In one embodiment, the compressed air may pass through a regulator 83 prior to entering the fluid passage 76. The regulator 83 may regulate the pressure of the compressed air entering the fluid passage 76 to at least partially ensure the uniform rotation of the impeller 71. In a more specific embodiment, the regulator 83 may regulate the pressure of compressed air entering the fluid passage 76 to 15 psi. In one embodiment, compressed air entering the fluid passage 76 may be supplied directly from a source of compressed air, not shown. In another embodiment, compressed air entering the fluid passage 76 may comprise at least a portion of the compressed air entering the pump 10 through the pump inlet 15. In a more specific embodiment, compressed air entering the fluid passage 76 may be supplied from the compressed air directed into the pilot valve assembly 28. In yet another embodiment, compressed air entering the fluid passage 76 may be supplied from compressed air being exhausted from the pump 10 through the exhaust port 32. Compressed air exiting the fluid passage 76 may be exhausted from the pump 10 into the ambient air or, may be directed back into the pump 10. In one embodiment, compressed air exiting the fluid passage 76 may be directed back into the pump 10 through the pump inlet 15. In another embodiment, compressed air exiting the fluid passage 76 may be directed to flow across a controller, not shown, or other electrical assembly for the purpose of cooling, lowering, or otherwise controlling the operating temperature of the controller or other electrical assembly.

With continuing reference to FIGS. 1, 4, and 5, the impeller 71 may be operationally connected to the rotor shaft 72 such that the rotation of the impeller 71 at least partially causes the rotation of the rotor shaft 72. In one embodiment, a gear assembly 77 may operationally connect the impeller 71 and the rotor shaft 72. The gear assembly 77 may allow the rotational properties of the impeller 71 to be altered when translated to the rotor shaft 72. The gear assembly 77 may allow a decreased or minimal amount of compressed air to be utilized for operating the power supply 1. In one embodiment, the gear assembly 77 may comprise a gear reduction assembly that at least partially causes the rotor shaft 72 to comprise a decreased rotational velocity and an increased torque with respect to the impeller 71. In a more specific embodiment, the gear assembly 77 may cause a gear reduction of 4:1. The rotor shaft 72 may be operationally connected to the rotor 73 such that the rotation of the rotor shaft 72 at least partially causes the rotation of the rotor 73. The stator 74 may be substantially encircle the rotor 73 such that the rotation of the rotor 73 causes at least a first magnet 78 to rotate relative to at least a first coil winding 79 thereby inducing an electric current to flow through the coil winding 79. In one embodiment, a plurality of magnets 78 may be coupled to the rotor 73 and a plurality of coil windings 79 may be coupled to the stator 74. The magnets 78 may have a staggered or alternating plurality such that the north and south poles of each magnet 78 alternate around the rotor 73. The stator 74 may comprise a first, second, and third coil winding 79. The first, second, and third coil windings 79 may be evenly spaced at intervals of about 120 degrees such that the rotation of the rotor 73 at least partially causes alternating magnetic fields to induce a subsequent three-phase alternating current in the stator 74. In one embodiment, the coil windings 79 may be wound around an iron ring 82 positioned adjacent to the magnets 78.

With continuing reference to FIGS. 1, 4, and 5, a plurality of wires or stator leads 80 may be utilized to direct the flow of current from the stator 74. In one embodiment, the current may be directed through a bridge rectifier 81 for supplying direct current to one or more components of the pump 10. Optionally, the power supply 1 may comprise a voltage regulator, not shown, for regulating the amount of voltage supplied to one or more components of the pump 10. The power supply 1 may be used to supply electrical power to any component of the pump 10 chosen with sound judgment by a person of ordinary skill in the art. In one embodiment, the power supply 1 may supply electrical power to a control device, not shown, for controlling the compressed air utilized in operating the pump 10. In another embodiment, the power supply 1 may supply power to a controller and/or solenoids for electronically controlling the movement of the main valve assembly 34. Examples of other devices or components of the pump 10 that may be supplied power by the power supply 1 include, but are not limited to, leak detectors, PH monitoring sensors, air flow meters, liquid flow meters, gas flow meters, pressure sensors, stroke sensors, wired communication devices, wireless communication devices, fluid sensing devices, liquid level sensors, liquid level controls, float switches, solenoids, valves, and pump control systems.

With continued reference now to FIGS. 1 and 4, in one embodiment, the power supply 1 may generate direct current. The power supply 1 may comprise the plurality of magnets 78 coupled to the stator 74 and the coil winding 79 coupled to the rotor 73. The rotation of the rotor 73 may cause the coil winding 79 to rotate with respect to the magnets 78 thereby inducing an electric current through the coil winding 79. The current induced in the coil winding 79 may comprise a direct current that is fed through a wire or rotor lead, not shown, to one or more components of the pump 10. The output supplied by the power supply 1 may be modified by varying one or more variables, such as, for example, the amount of compressed air directed through the fluid passage 76; the speed at which the compressed air flows through the fluid passage 76; the configuration of the impeller 71 (i.e., size and/or number of blades 75); the configuration of the gear assembly 77; the size and number of magnets 78; and, the size, material comprising the coil winding, number of windings per coil winding, and the total number of coil windings 79.

In another embodiment, the power supply 1 may comprise a piezo-power generation assembly. Instead of utilizing compressed air, the piezo-power generation assembly may utilize the vibration or movement of the pump 10 while operating to generate electrical power. The power supply 1 may comprise a piezoelectric material. The vibration of the pump 10 during operation of the pump 10 may both stress and strain the piezoelectric material. As is known in the art, when subjected to the stress/strain, the piezoelectric material produces electrical charge on its surface. The vibration of the pump 10 may cause the piezoelectric material to produce an AC current due to the piezoelectric material producing a charge traveling in one direction when the piezoelectric material is subjected to stress and a charge traveling in the opposite direction when the piezoelectric material is subjected to strain. In one embodiment, the alternating current generated by the power supply 1 may be transformed to direct current by the bridge rectifier 81 as is known in the art. A power supply, which utilizes compressed air may also comprise a piezo-power assembly. A power supply may generate electrical power utilizing compressed air and may further comprises a piezo-power assembly having piezoelectric material which may be used for producing alternating current or direct current utilizing vibration of the pump.

Figure 7:
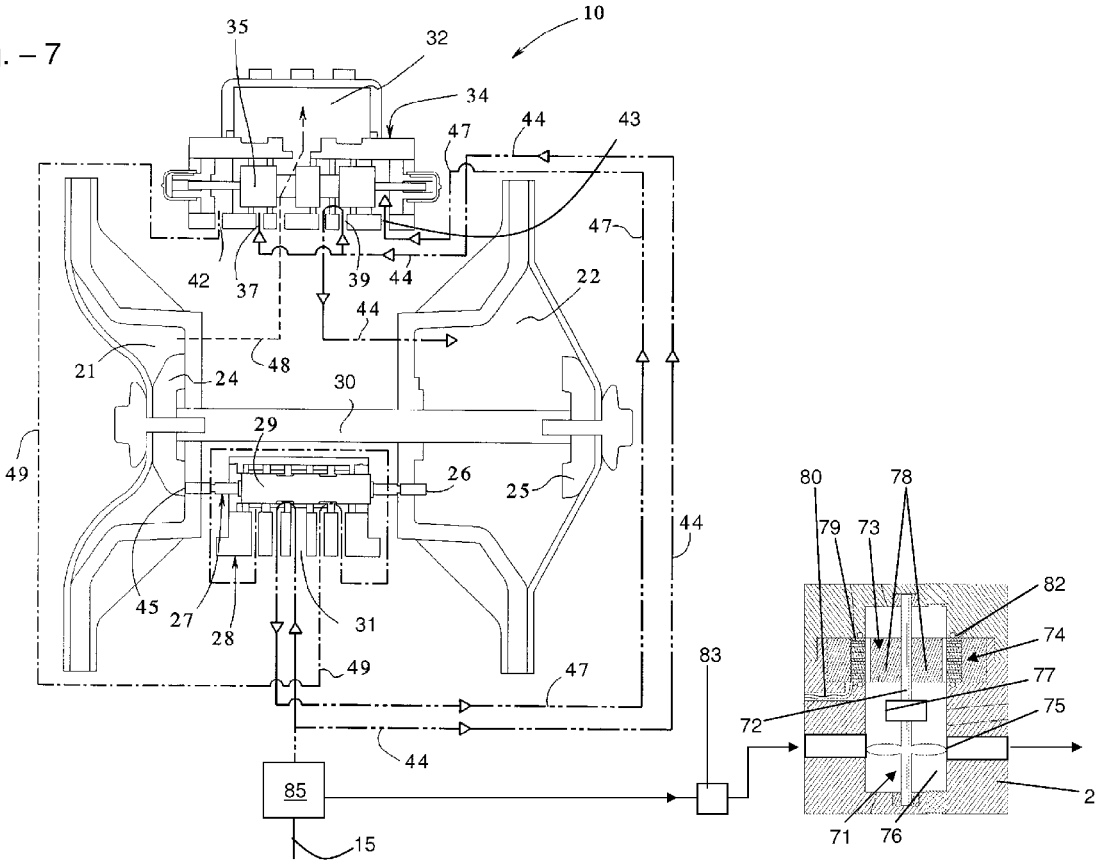
FIG. 7 shows a schematic illustration of an air operated diaphragm pump having a power supply for supplying electrical power independent of the operation of the pump according to one embodiment of the invention.

With reference now to FIG. 7, the power supply 1 may be adapted to supply electrical power independently from the operation of the pump 10. In one embodiment, a valve 85 may be positioned in fluid communication with the compressed air entering the pump 10 through pump inlet 15. The valve 85 may allow for compressed air to be selectively supplied to the power supply 1 while preventing compressed air from being supplied to components of the pump 10 thereby preventing the operation of the pump 10 (i.e., the first and second diaphragm chambers 21, 22) while allowing the power supply 1 to provide electrical power. Additionally, the valve 85 may allow compressed air to be contemporaneously supplied to the pump 10 and the power supply 1 such that the power supply 1 can provide electrical power to one or more components of the pump 10 during operation of the pump 10. Further, the valve 85 may allow compressed air to be supplied to operate the pump 10 while preventing compressed air from being supplied to the power supply 1 thereby preventing the power supply 1 from providing electrical power during the operation of the pump 10. The valve 85 may comprise a valve that can be manually actuated by an operator and/or may comprise a valve that can be selectively actuated by a controller, not shown, in accordance with preprogrammed instructions contained in a memory portion, not shown, of the controller, as is well known in the art. The electrical power supplied by the power supply 1 may be used to power various electrical components of the pump 10 during periods in which the pump 10 is not currently operating. In one embodiment, the pump 10 may comprise a rechargeable battery, not shown, utilized to supply electrical power to one or more components of the pump 10 that is supplied electrical power by the power supply 1 to recharge the rechargeable battery, not shown. In a more specific embodiment, upon termination of operation of the pump 10, the controller, not shown, may control the valve 85 to supply compressed air to the power supply 1 while preventing compressed air from being supplied to operate the pump 10 to cause the power supply 1 to supply electrical power that is utilized to recharge the rechargeable battery, not shown. Upon determining that the rechargeable battery, not shown, is fully charged, the controller, not shown, may control the valve 85 to prevent compress air from being further supplied to the power supply 1. In another embodiment, the power supply 1 may supply electrical power that is utilized to power various diagnostic or ancillary components of the pump 10. In one embodiment, the power supply 1 may supply electrical power to devices that provide diagnostic information relating to the operation of the pump 10, such as, for example, a pump cycle counter, a failure detection device, a device for determining pump speed, or any other device for providing pump diagnostic information chosen with sound judgment by a person of ordinary skill in the art.

The embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A pump comprising:

a first diaphragm assembly, wherein the first diaphragm assembly is disposed in a first chamber and includes a first diaphragm forming a first pumping chamber and a first diaphragm chamber within the first chamber;

a second diaphragm assembly, wherein the second diaphragm assembly is disposed in a second chamber and includes a second diaphragm forming a second pumping chamber and a second diaphragm chamber within the second chamber, wherein a connecting rod is operatively connected to the first and the second diaphragms and allows the first and the second diaphragm assemblies to reciprocate together between a first diaphragm position and a second diaphragm position;

a center section, wherein the center section at least partially causes a compressed fluid to be alternately supplied to or exhausted from the first and the second diaphragm chambers;

an inlet adapted to provide fluid communication for the compressed fluid from an associated source of compressed fluid and to one or more of the pump and an integrated power supply;

a valve in fluid communication with the inlet, said valve being adapted to provide selectable fluid communication therethrough for said compressed fluid between said inlet and one or more of the pump and the integrated power supply;

wherein the integrated power supply utilizes the compressed fluid to supply power to at least a first component of the pump; and wherein the integrated power supply generates electric power.

2. The pump of claim 1, wherein the integrated power supply generates a direct current.

3. The pump of claim 1, wherein the integrated power supply comprises:

an impeller;

a gear reduction assembly; and, an alternator having a rotor and a stator, wherein at least a portion of the compressed air entering into the pump passes over the impeller and causes the impeller to rotate at a first velocity and generate a first torque, wherein the impeller is operatively connected to the gear reduction assembly, wherein the gear reduction assembly causes the rotor to rotate at a second velocity and generate a second torque.

4. The pump of claim 3, wherein the integrated power supply further comprises:

a regulator, wherein the regulator regulates flow of compressed air across the impeller.

5. The pump of claim 3, wherein the integrated power supply further comprises:

a bridge rectifier.

6. The pump of claim 3, wherein the alternator comprises:

a plurality of magnets coupled to the stator; and a coil winding coupled to the rotor.

7. A pump comprising:

a first diaphragm assembly, wherein the first diaphragm assembly is disposed in a first chamber and includes a first diaphragm forming a first pumping chamber and a first diaphragm chamber within the first chamber;

a second diaphragm assembly, wherein the second diaphragm assembly is disposed in a second chamber and includes a second diaphragm forming a second pumping chamber and a second diaphragm chamber within the second chamber, wherein a connecting rod is operatively connected to the first and the second diaphragms and allows the first and the second diaphragm assemblies to reciprocate together between a first diaphragm position and a second diaphragm position;

a center section, wherein the center section at least partially causes a compressed fluid to be alternately supplied to or exhausted from the first and the second diaphragm chambers;

an integrated power supply, wherein the integrated power supply utilizes compressed air supplied to the pump to supply power to at least a first component of the pump; and wherein the integrated power supply generates an alternating current.

8. The pump of claim 7, wherein the integrated power supply comprises:

an impeller;

a gear reduction assembly; and, an alternator having a rotor and a stator, wherein at least a portion of the compressed air entering into the pump passes over the impeller and causes the impeller to rotate at a first velocity and generate a first torque, wherein the impeller is operatively connected to the gear reduction assembly, wherein the gear reduction assembly causes the rotor to rotate at a second velocity and generate a second torque.

9. The pump of claim 8, wherein the integrated power supply further comprises:

a regulator, wherein the regulator regulates flow of compressed air across the impeller.

10. The pump of claim 8, wherein the integrated power supply further comprises:

a bridge rectifier.

11. The pump of claim 8, wherein the alternator comprises:

a plurality of magnets coupled to the stator; and a coil winding coupled to the rotor.

12. A method for supplying power to a pump, the method comprising the steps of:

providing a first diaphragm assembly, wherein the first diaphragm assembly is disposed in a first chamber and includes a first diaphragm forming a first pumping chamber and a first diaphragm chamber within the first chamber;

a second diaphragm assembly, wherein the second diaphragm assembly is disposed in a second chamber and includes a second diaphragm forming a second pumping chamber and a second diaphragm chamber within the second chamber, wherein a connecting rod is operatively connected to the first and the second diaphragms and allows the first and the second diaphragm assemblies to reciprocate together between a first diaphragm position and a second diaphragm position;

a center section, wherein the center section at least partially causes a compressed fluid to be alternately supplied to or exhausted from the first and the second diaphragm chambers;

an inlet adapted to provide fluid communication for the compressed fluid from an associated source of compressed fluid and to one or more of the pump and an integrated power supply;

a valve in fluid communication with the inlet, said valve being adapted to provide selectable fluid communication therethrough for said compressed fluid between said inlet and one or more of the pump and the integrated power supply; and generating electrical power, wherein the integrated power supply generates electrical power utilizing the compressed fluid supplied to the pump.

13. The method of claim 12, further comprising the step of:

generating direct current to supply power to a pump component.

14. The method of claim 12, wherein the integrated power supply comprises:

an impeller;

a gear reduction assembly, the impeller operatively connected to the gear reduction assembly; and, an alternator, the method further comprising the steps of:

passing air entering into the pump over the impeller;

rotating the impeller at a first velocity;

generating a first torque, rotating a rotor at a second velocity via the gear reduction assembly; and generating a second torque.

15. The method of claim 14, wherein the integrated power supply further comprises a regulator, the method further comprising the step of:

regulating flow of compressed air across the impeller.

16. The method of claim 14, wherein the integrated power supply further comprises:

a bridge rectifier.

17. A method for supplying power to a pump, the method comprising the steps of:

providing a first diaphragm assembly, wherein the first diaphragm assembly is disposed in a first chamber and includes a first diaphragm forming a first pumping chamber and a first diaphragm chamber within the first chamber;

a second diaphragm assembly, wherein the second diaphragm assembly is disposed in a second chamber and includes a second diaphragm forming a second pumping chamber and a second diaphragm chamber within the second chamber, wherein a connecting rod is operatively connected to the first and the second diaphragms and allows the first and the second diaphragm assemblies to reciprocate together between a first diaphragm position and a second diaphragm position;

a center section, wherein the center section at least partially causes a compressed fluid to be alternately supplied to or exhausted from the first and the second diaphragm chambers; and an integrated power supply;

generating electrical power, wherein the integrated power supply generates electrical power utilizing compressed air supplied to the pump; and generating alternating current to supply power to a pump component.

18. The method of claim 17, wherein the integrated power supply comprises:

an impeller;

a gear reduction assembly, the impeller operatively connected to the gear reduction assembly; and, an alternator, the method further comprising the steps of:

passing air entering into the pump over the impeller;

rotating the impeller at a first velocity;

generating a first torque, rotating a rotor at a second velocity via the gear reduction assembly; and generating a second torque.

19. The method of claim 18, wherein the integrated power supply further comprises a regulator, the method further comprising the step of:

regulating flow of compressed air across the impeller.

20. The method of claim 18, wherein the integrated power supply further comprises:

a bridge rectifier.

* * * * *